US010378781B2

(12) United States Patent
Kono et al.

(10) Patent No.: US 10,378,781 B2
(45) Date of Patent: Aug. 13, 2019

(54) OUTDOOR UNIT FOR REFRIGERATION CYCLE APPARATUS, AND REFRIGERATION CYCLE APPARATUS

(71) Applicant: Mitsubishi Electric Corporation, Tokyo (JP)

(72) Inventors: Atsushi Kono, Tokyo (JP); Seiji Nakashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 139 days.

(21) Appl. No.: 15/562,052

(22) PCT Filed: Jun. 19, 2015

(86) PCT No.: PCT/JP2015/067703
§ 371 (c)(1),
(2) Date: Sep. 27, 2017

(87) PCT Pub. No.: WO2016/203636
PCT Pub. Date: Dec. 22, 2016

(65) Prior Publication Data
US 2018/0106485 A1 Apr. 19, 2018

(51) Int. Cl.
*F24F 1/48* (2011.01)
*F24F 1/38* (2011.01)
(Continued)

(52) U.S. Cl.
CPC ..... *F24F 1/48* (2013.01); *F24F 1/14* (2013.01); *F24F 1/38* (2013.01); *F24F 1/50* (2013.01); *F24F 1/16* (2013.01); *F24F 1/18* (2013.01)

(58) Field of Classification Search
CPC ..... F24F 1/14; F24F 1/16; F24F 1/18; F24F 1/38; F24F 1/48; F24F 1/50
See application file for complete search history.

(56) References Cited

U.S. PATENT DOCUMENTS 9,605,686 B2 * 3/2017 Hamada ..... F04D 29/384
2011/0174011 A1 * 7/2011 Kim ..... F04D 19/007 62/426
2015/0184872 A1 * 7/2015 Oh ..... F24F 1/56 165/122

FOREIGN PATENT DOCUMENTS

JP 2006-189196 A 7/2006
JP 2012-072937 A 4/2012
(Continued)

OTHER PUBLICATIONS

International Search Report of the International Searching Authority dated Aug. 18, 2015 for the corresponding international application No. PCT/JP2015/067703 (and English translation).

*Primary Examiner* — Filip Zec
(74) *Attorney, Agent, or Firm* — Posz Law Group, PLC

(57) ABSTRACT

An outdoor unit for a refrigeration cycle apparatus includes an outdoor heat exchanger arranged around an axis on an upstream side of an airflow with respect to a propeller fan. Further, the outdoor heat exchanger includes a first flat surface portion, a second flat surface portion, and a curved portion connecting the first and second flat surface portions to each other. An airflow directing plate is opposed to an end portion of the outdoor heat exchanger on the propeller fan side from the axis side of the propeller fan. The airflow directing plate is opposed to at least any one of the first flat surface portion and the second flat surface portion without being opposed to the curved portion.

9 Claims, 7 Drawing Sheets

(51) Int. Cl.

| | |
|---|---|
| ***F24F 1/14*** | (2011.01) |
| ***F24F 1/50*** | (2011.01) |
| *F24F 1/16* | (2011.01) |
| *F24F 1/18* | (2011.01) |

(56) References Cited

FOREIGN PATENT DOCUMENTS

| | | | |
|---|---|---|---|
| JP | 2013-228168 | A | 11/2013 |
| JP | 2014-095505 | A | 5/2014 |

* cited by examiner

OUTDOOR UNIT FOR REFRIGERATION CYCLE APPARATUS, AND REFRIGERATION CYCLE APPARATUS

CROSS REFERENCE TO RELATED APPLICATION

This application is a U.S. national stage application of PCT/JP2015/067703 filed on Jun. 19, 2015, the disclosure of which is incorporated herein by reference.

TECHNICAL FIELD

The present invention relates to an outdoor unit for a refrigeration cycle apparatus including a heat exchanger, and to a refrigeration cycle apparatus.

BACKGROUND ART

In a top-blow type outdoor unit for an air-conditioning apparatus, a propeller fan is arranged in an upper portion of a casing, and a heat exchanger is arranged in the casing. Further, in the top-blow type outdoor unit for an air-conditioning apparatus, an airflow generated through the rotation of the propeller fan passes through the heat exchanger so that heat is exchanged between outside air and refrigerant flowing through the heat exchanger. Normally, an air velocity becomes higher at a position closer to the propeller fan. Accordingly, the air velocity in an upper portion of the heat exchanger is higher than the air velocity in a lower portion of the heat exchanger, with the result that an air velocity distribution in the heat exchanger is uneven. When the air velocity distribution in the heat exchanger is uneven, efficiency of heat exchange in the heat exchanger is reduced.

Hitherto, in order to reduce unevenness of an air velocity distribution in a heat exchanger, there has been proposed a top-blow type outdoor unit including a cylindrical duct arranged in an internal space in an upper portion of the outdoor unit. With this configuration, airflow resistance in an upper portion of the heat exchanger is increased as compared to the airflow resistance in a lower portion of the heat exchanger (for example, see Patent Literature 1).

CITATION LIST

Patent Literature

[PTL 1] JP 2014-095505 A

SUMMARY OF INVENTION

Technical Problem

However, the duct completely partitions off a space between an axis of a rotation shaft of the propeller fan and the heat exchanger in a circumferential direction. Thus, the airflow resistance in the upper portion of the heat exchanger may be excessively increased so that the air velocity in the upper portion of the heat exchanger may be inversely lower than the air velocity in the lower portion of the heat exchanger. Consequently, there is a fear in that unevenness of the air velocity distribution in the heat exchanger cannot be reduced, and in that it may be difficult to enhance efficiency of heat exchange in the heat exchanger.

Further, the airflow having passed through the upper portion of the heat exchanger is directed toward an inner peripheral portion of the propeller fan, and hence the airflow is less likely to flow into an outer peripheral portion of the propeller fan. Accordingly, an air eddy is liable to be generated between the outer peripheral portion of the propeller fan and the upper portion of the heat exchanger, and noise is liable to be caused. In the related-art top-blow type outdoor unit described in Patent Literature 1 mentioned above, the airflow having passed through the upper portion of the heat exchanger is forcibly led to the outer peripheral portion of the propeller fan by the duct, thereby being capable of preventing generation of the air eddy. However, a difference in air velocity between an inside and an outside of the duct is liable to be increased. Therefore, a distribution of suction airflow is liable to be uneven between the inner peripheral portion and the outer peripheral portion of the propeller fan, with the result that efficiency of the propeller fan may be reduced.

The present invention has been made in order to solve the above-mentioned problem, and has an object to obtain an outdoor unit for a refrigeration cycle apparatus which can enhance efficiency of heat exchange in a heat exchanger and can enhance efficiency of a propeller fan, and to obtain a refrigeration cycle apparatus.

Solution to Problem

According to one embodiment of the present invention, there is provided an outdoor unit for a refrigeration cycle apparatus, including: an air-sending device including a propeller fan configured to generate an airflow by rotating about an axis of the propeller fan; an outdoor heat exchanger, which is arranged around the axis on an upstream side of the airflow with respect to the propeller fan, and includes a first flat surface portion, a second flat surface portion, and a curved portion connecting the first flat surface portion and the second flat surface portion to each other; and an airflow directing plate arranged so as to be opposed to an end portion of the outdoor heat exchanger on the propeller fan side from the axis side, the airflow directing plate being arranged so as to be opposed to at least any one of the first flat surface portion and the second flat surface portion without being opposed to the curved portion.

Advantageous Effects of Invention

According to the outdoor unit for a refrigeration cycle apparatus of the present invention, unevenness of an air velocity distribution in the outdoor heat exchanger can be reduced, thereby being capable of enhancing efficiency of heat exchange in the outdoor heat exchanger. Further, the air velocity distribution in the propeller fan can be prevented from being uneven, thereby being capable of enhancing efficiency of the propeller fan.

DESCRIPTION OF EMBODIMENTS

Now, exemplary embodiments of the present invention are described with reference to the drawings.

Embodiment 1

Figure 1:
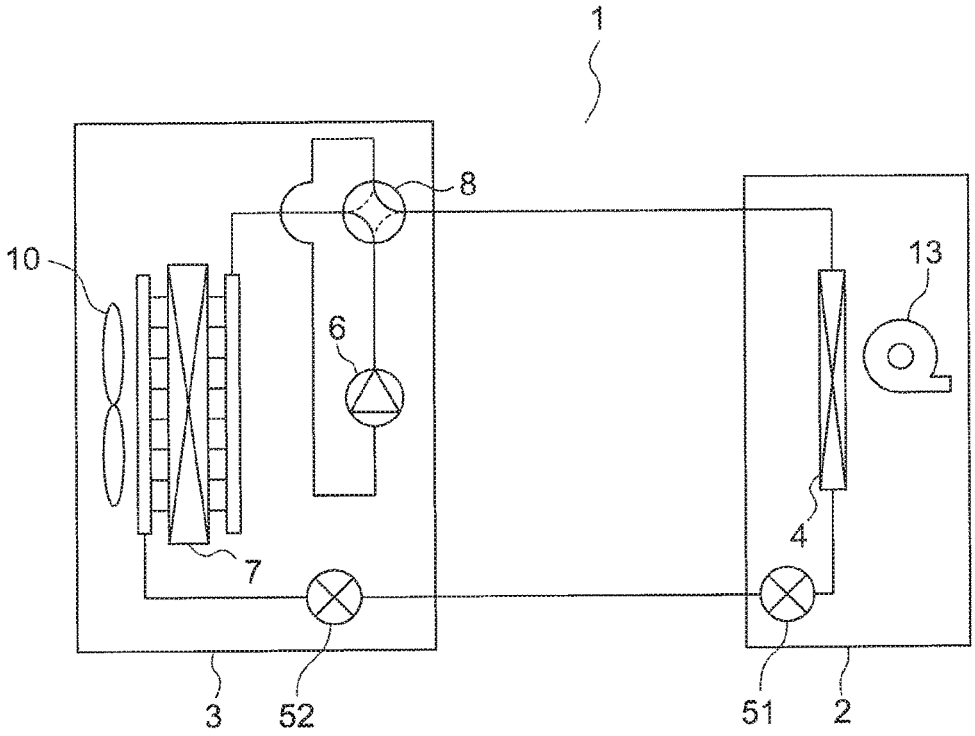
FIG. 1 is a view for illustrating a configuration of an air-conditioning apparatus of Embodiment 1 of the present invention.

In Embodiment 1 of the present invention, an air-conditioning apparatus is described as a specific example of a refrigeration cycle apparatus. FIG. 1 is a view for illustrating a configuration of an air-conditioning apparatus of Embodiment 1 of the present invention. An air-conditioning apparatus 1 includes an indoor unit 2 for a refrigeration cycle apparatus (hereinafter, simply referred to as "indoor unit"), and an outdoor unit 3 for a refrigeration cycle apparatus (hereinafter, simply referred to as "outdoor unit"). The indoor unit 2 includes an indoor unit device and a first air-sending device 13. The indoor unit device includes an indoor heat exchanger 4 and a first expansion valve 51. The first air-sending device 13 is configured to generate an airflow passing through the indoor heat exchanger 4. The outdoor unit 3 includes an outdoor unit device and a second air-sending device 10. The outdoor unit device includes a compressor 6, an outdoor heat exchanger 7, a second expansion valve 52, and a four-way valve 8 being an electromagnetic valve. The second air-sending device 10 is configured to generate an airflow passing through the outdoor heat exchanger 7.

Refrigerant circulating through the indoor unit 2 and the outdoor unit 3 is compressed by the compressor 6, and is expanded by the first expansion valve 51 and the second expansion valve 52. The first air-sending device 13 is operated to cause indoor air to pass through the indoor heat exchanger 4 as the airflow. Thus, in the indoor heat exchanger 4, heat is exchanged between the indoor air and the refrigerant. The second air-sending device 10 is operated to cause outdoor air, namely, outside air to pass through the outdoor heat exchanger 7 as the airflow. Thus, in the outdoor heat exchanger 7, heat is exchanged between the outdoor air and the refrigerant.

Operation of the air-conditioning apparatus 1 can be switched to any one of cooling operation and heating operation. The four-way valve 8 switches refrigerant flow paths in accordance with switching of the operation of the air-conditioning apparatus 1 between cooling operation and heating operation. Specifically, the four-way valve 8 switches the refrigerant flow paths between a refrigerant flow path during cooling operation in which the refrigerant is led from the compressor 6 into the outdoor heat exchanger 7 and the refrigerant is led from the indoor heat exchanger 4 into the compressor 6, and a refrigerant flow path during heating operation in which the refrigerant is led from the compressor 6 into the indoor heat exchanger 4 and the refrigerant is led from the outdoor heat exchanger 7 into the compressor 6.

During cooling operation of the air-conditioning apparatus 1, the refrigerant is compressed by the compressor 6. Then, the compressed refrigerant transfers heat to the outside air and is condensed in the outdoor heat exchanger 7. After that, the refrigerant condensed in the outdoor heat exchanger 7 is successively expanded by the first expansion valve 51 and the second expansion valve 52. Then, the expanded refrigerant is evaporated in the indoor heat exchanger 4 by receiving heat from the indoor air, and returns to the compressor 6. Therefore, during cooling operation of the air-conditioning apparatus 1, the outdoor heat exchanger 7 functions as a condenser configured to condense the refrigerant, and the indoor heat exchanger 4 functions as an evaporator configured to evaporate the refrigerant.

Meanwhile, during heating operation of the air-conditioning apparatus 1, the refrigerant is compressed by the compressor 6. Then, the compressed refrigerant transfers heat to the indoor air and is condensed in the indoor heat exchanger 4. After that, the refrigerant condensed in the indoor heat exchanger 4 is successively expanded by the second expansion valve 52 and the first expansion valve 51. Then, the expanded refrigerant is evaporated in the outdoor heat exchanger 7 by receiving heat from the outdoor air, and returns to the compressor 6. Therefore, during heating operation of the air-conditioning apparatus 1, the outdoor heat exchanger 7 functions as an evaporator configured to evaporate the refrigerant, and the indoor heat exchanger 4 functions as a condenser configured to condense the refrigerant.

Figure 2:
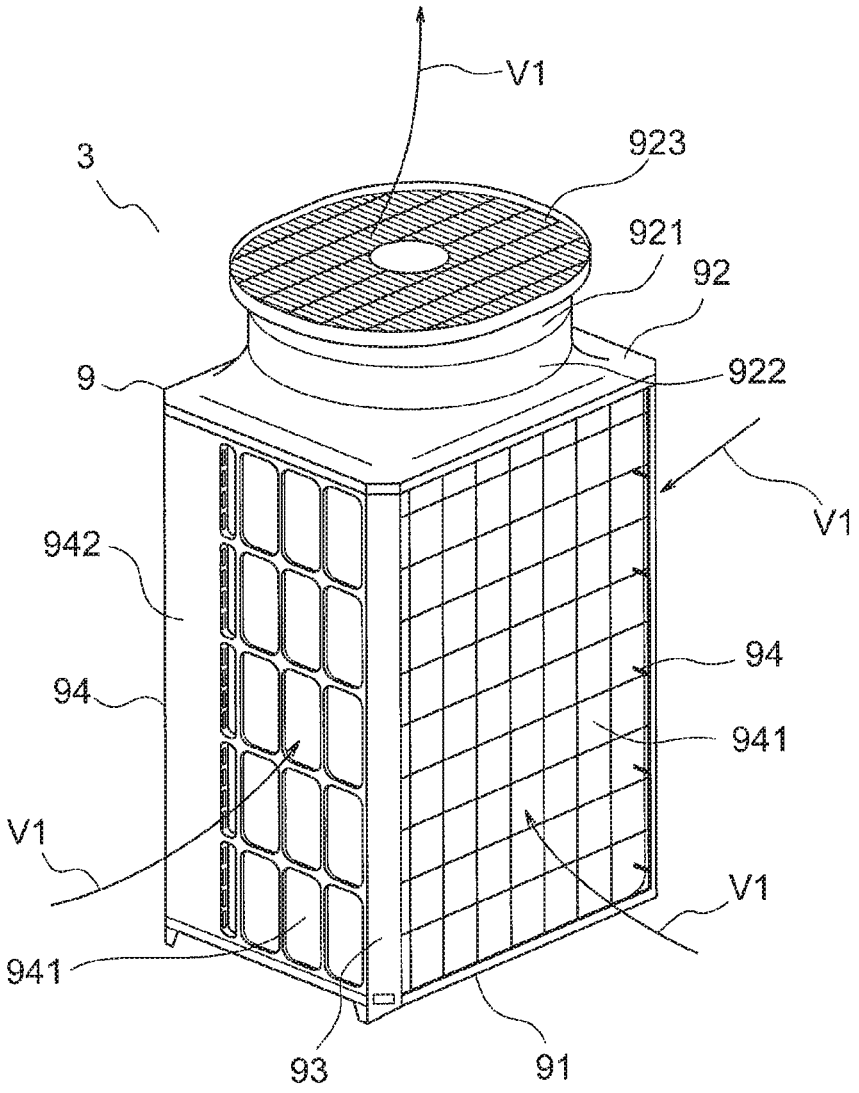
FIG. 2 is a perspective view for illustrating an outdoor unit of FIG. 1.
Figure 3:
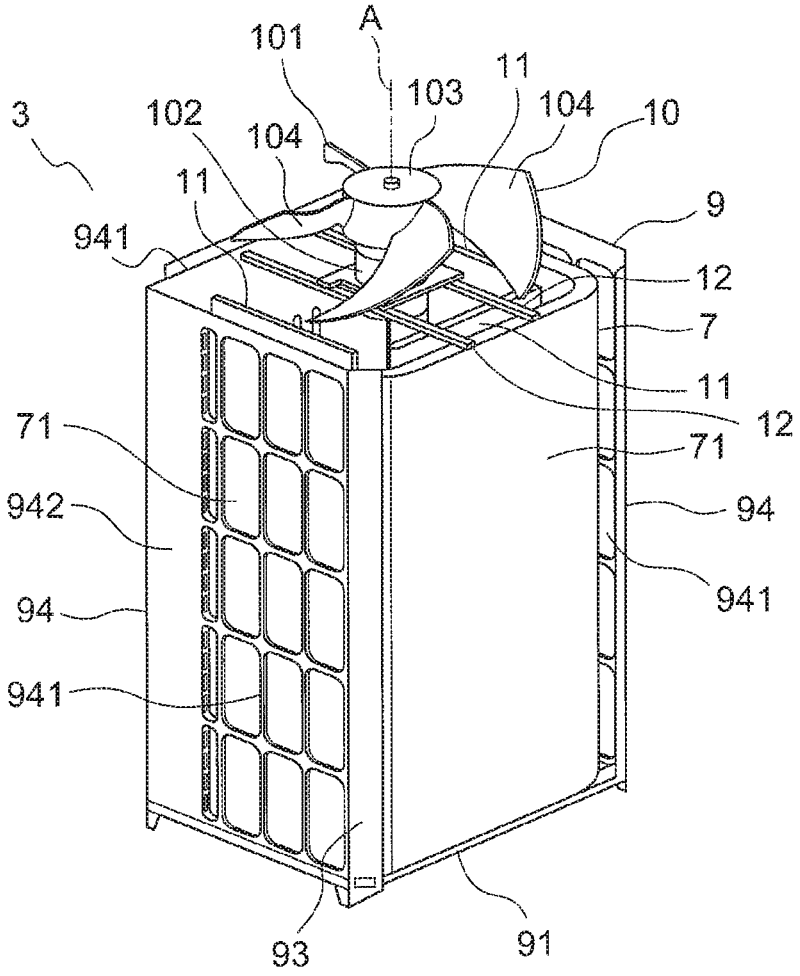
FIG. 3 is a perspective view for illustrating the outdoor unit from which a part of a casing of FIG. 2 is removed.

FIG. 2 is a perspective view for illustrating the outdoor unit 3 of FIG. 1. Further, FIG. 3 is a perspective view for illustrating the outdoor unit 3 from which a part of a casing 9 of FIG. 2 is removed. The outdoor unit 3 includes the above-mentioned outdoor unit device, the casing 9 configured to accommodate the outdoor unit device, the air-sending device 10 mounted to a top of the casing 9, and a plurality of airflow directing plates 11 arranged in the casing 9 and configured to direct the airflow in the casing 9.

The outdoor unit device includes a drive control device and a heat transfer tube in addition to the compressor 6, the outdoor heat exchanger 7, and the four-way valve 8. The drive control device is configured to control driving of the compressor 6, the four-way valve 8, and the air-sending device 10. The heat transfer tube allows the refrigerant to flow therethrough. In FIG. 2 and FIG. 3, only the outdoor heat exchanger 7 of the outdoor unit device is illustrated.

The casing 9 includes a bottom plate 91, a top plate 92, a plurality of support pillars 93, and a plurality of side panels 94. The top plate 92 is arranged above the bottom plate 91. The plurality of support pillars 93 are fixed to an outer peripheral portion of the bottom plate 91 apart from each other and are configured to support the top plate 92. The plurality of side panels 94 are each arranged in a space between the support pillars 93 so as to form side surfaces of the casing 9. In this example, each of the bottom plate 91 and the top plate 92 has a substantially quadrangular shape, and the four support pillars 93 are fixed at four corners of the bottom plate 91 and at four corners of the top plate 92. Therefore, in this example, the four side panels 94 form the side surfaces of the casing 9.

As illustrated in FIG. 2, an air outlet 921 is formed in a center of the top plate 92. Further, a bellmouth 922 is fixed to an upper surface of the top plate 92 so as to surround the air outlet 921. A grille 923 is mounted to the bellmouth 922 so as to cover an opening portion of the bellmouth 922.

As illustrated in FIG. 3, the air-sending device 10 is supported by a plurality of bar-shaped air-sending-device supports 12 that are mounted to the top plate 92 of the casing 9 to extend horizontally. Further, the air-sending device 10 includes a propeller fan 101 and a fan motor 102. The propeller fan 101 is rotated about an axis A extending along a height direction of the outdoor unit 3. The fan motor 102 is coupled to the propeller fan 101 and functions as a drive unit configured to generate a driving force of rotating the propeller fan 101.

The propeller fan 101 is arranged at a position shifted upward from the outdoor heat exchanger 7 in a direction extending along the axis A, that is, in an axial direction of the propeller fan 101. In other words, when the propeller fan 101 and the outdoor heat exchanger 7 are seen from a direction orthogonal to the axis A, the propeller fan 101 is arranged at a position shifted from a region of the outdoor heat exchanger 7 in the direction extending along the axis A (upward in this example). With this configuration, a range containing the propeller fan 101, and a range containing the outdoor heat exchanger 7 do not overlap each other in the direction extending along the axis A. Further, the propeller fan 101 is arranged inside the bellmouth 922.

The fan motor 102 is placed on the air-sending-device supports 12 so that an axis of a motor shaft of the fan motor 102 matches with the axis A. The propeller fan 101 is coupled to the motor shaft of the fan motor 102 at an upper portion of the fan motor 102. Further, the propeller fan 101 includes a boss 103 and a plurality of blades 104. The boss 103 is fixed to the motor shaft of the fan motor 102. The plurality of blades 104 are formed on an outer peripheral portion of the boss 103. The blades 104 are arranged apart from each other along a circumferential direction of the boss 103.

Figure 4:
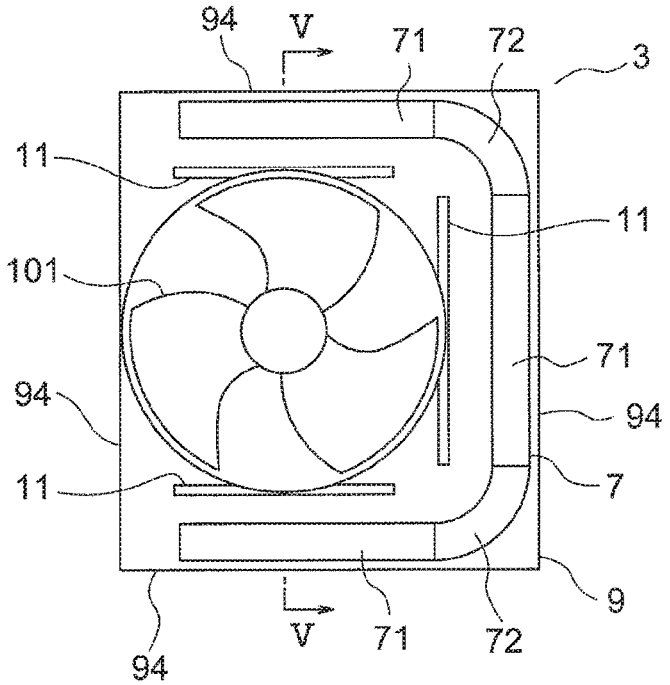
FIG. 4 is a top view for illustrating the outdoor unit of FIG. 3.
Figure 5:
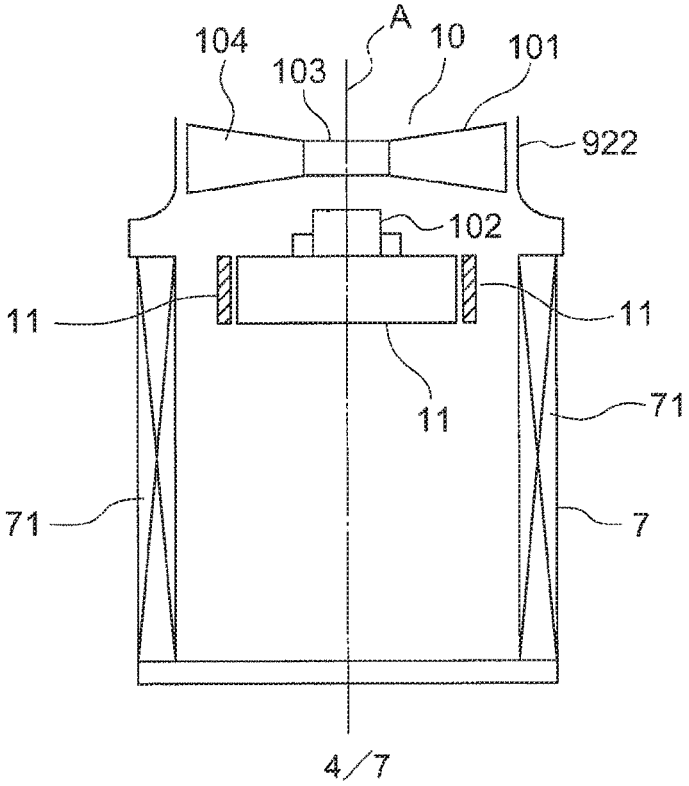
FIG. 5 is a schematic sectional view taken along the line V-V of FIG. 4.

FIG. 4 is a top view for illustrating the outdoor unit 3 of FIG. 3. Further, FIG. 5 is a schematic sectional view taken along the line V-V of FIG. 4. As illustrated in FIG. 4, the outdoor heat exchanger 7 is arranged around the axis A on an upstream side of the airflow with respect to the propeller fan 101. Further, as illustrated in FIG. 5, the outdoor heat exchanger 7 is arranged along the axis A. Still further, the outdoor heat exchanger 7 includes a plurality of flat surface portions 71 and a plurality of curved portions 72. The plurality of flat surface portions 71 are arranged apart from each other so as to surround the axis A. The plurality of curved portions 72 connect together the flat surface portions 71 that are adjacent to each other. In other words, when the outdoor heat exchanger 7 is seen from the direction extending along the axis A, the flat surface portions 71 are arranged so as to surround the axis A from a plurality of different directions, and each of the curved portions 72 is interposed between the flat surface portions 71. One of two adjacent flat surface portions 71 of the outdoor heat exchanger 7 is referred to as a first flat surface portion, and another one of the two adjacent flat surface portions 71 is referred to as a second flat surface portion. Therefore, the first flat surface portion 71 and the second flat surface portion 71 face toward different directions. Further, each of the curved portions 72 connects the first flat surface portion 71 and the second flat surface portion 71 together. Each of the curved portions 72 has an arc shape when seen from the direction extending along the axis A.

In this example, three flat surface portions 71 are arranged in the casing 9 so as to be respectively opposed to three of the four side panels 94 surrounding the axis A, and the three flat surface portions 71 are connected together by the two curved portions 72. Therefore, in this example, when the outdoor heat exchanger 7 is seen from the direction extending along the axis A, the outdoor heat exchanger 7 has a U-shape defined by the three flat surface portions 71 and the two curved portions 72.

The flat surface portions 71 and the curved portions 72 of the outdoor heat exchanger 7 each include a plurality of plate-like fins and a heat transfer tube. The plurality of plate-like fins are aligned in a circumferential direction of the outdoor heat exchanger 7. The heat transfer tube passes through the fins in an aligning direction of the fins. The refrigerant circulating in the air-conditioning apparatus 1 flows through the heat transfer tube of the outdoor heat exchanger 7. The heat exchange between the refrigerant and the outside air in the outdoor heat exchanger 7 is performed through the fins and the heat transfer tube.

As illustrated in FIG. 2, a part of each side panel 94 that is opposed to each flat surface portion 71 is referred to as a panel air passage section 941 configured to allow passage of the airflow, and a part of each side panel 94 that is not opposed to each flat surface portion 71 is referred to as a panel shielding section 942 formed of a plate and configured to inhibit passage of the airflow. The panel air passage section 941 is formed of opening portions partitioned by a lattice. As illustrated in FIG. 3, slits are formed in portions of the panel shielding section 942 to allow passage of the airflow.

In the direction extending along the axis A, the outdoor heat exchanger 7 is divided into an end portion on the propeller fan 101 side (namely, upper end portion), an end portion opposite to the end portion on the propeller fan 101 side (namely, lower end portion), and an intermediate portion interposed between the end portion on the propeller fan 101 side and the end portion opposite to the end portion on the propeller fan 101 side. As illustrated in FIG. 5, each of the airflow directing plates 11 is opposed to the upper end portion of the outdoor heat exchanger 7 (namely, end portion of the outdoor heat exchanger 7 on the propeller fan 101 side) from the axis A side. The upper end portion of the outdoor heat exchanger 7 has a constant dimension smaller than a half of an entire dimension of the outdoor heat exchanger 7 in the direction extending along the axis A. Each of the airflow directing plates 11 is opposed to only the upper end portion of the outdoor heat exchanger 7, and is not opposed to the lower end portion and the intermediate portion of the outdoor heat exchanger 7. With this configuration, a space between the outdoor heat exchanger 7 and the axis A is partitioned only within an upper range in the casing 9 close to the propeller fan 101. Further, each of the airflow directing plates 11 is not opposed to the curved portions 72, but is opposed to at least any one of the flat surface portions 71. With this configuration, when the outdoor heat exchanger 7 is seen from the direction extending along the axis A, only a space between the axis A and at least any one of the flat surface portions 71 is partitioned by the airflow directing plate 11, whereas a space between the axis A and each of the curved portions 72 is open without being partitioned by the airflow directing plate 11.

In this example, as illustrated in FIG. 4, the three airflow directing plates 11 are arranged in the casing 9 so as to be opposed to the three flat surface portions 71, respectively. Further, in this example, each of the airflow directing plates 11 is arranged along the axis A, and each of the airflow directing plates 11 has a rectangular shape. Still further, in this example, each of the airflow directing plates 11 is arranged so as to overlap the outer peripheral portion of the propeller fan 101 when seen from the direction extending along the axis A. Still further, in this example, the airflow directing plate 11 and the flat surface portion 71 that are opposed to each other have the same length on a plane perpendicular to the axis A. Still further, in this example, the airflow directing plates 11 are supported by the air-sending-device supports 12, respectively. The airflow directing plates 11 may be supported by the outdoor heat exchanger 7 or the side panels 94. Still further, the airflow directing plates 11 and the air-sending-device supports 12 may be formed integrally with each other.

When the propeller fan 101 is rotated about the axis A in the outdoor unit 3, as indicated by the arrows V1 of FIG. 2, an airflow that flows into the casing 9 from the panel air passage sections 941 through the outdoor heat exchanger 7 and then flows out from the casing 9 through the air outlet 921 is generated as the air. That is, the outdoor unit 3 is constructed as a so-called top-blow type outdoor unit. In the outdoor heat exchanger 7, the airflow flows from the panel air passage sections 941 of the side panels 94 through the outdoor heat exchanger 7 so that heat exchange is performed between the outside air and the refrigerant passing through the heat transfer tube of the outdoor heat exchanger 7.

In the upper end portion of the outdoor heat exchanger 7, that is, in the end portion of the outdoor heat exchanger 7 on the propeller fan 101 side, there are a region opposed to the airflow directing plates 11 and a region that is not opposed to the airflow directing plates 11. Therefore, in a range corresponding to arrangement heights of the airflow directing plates 11 in the casing 9, that is, in the upper range in the casing 9, a part of the airflow having passed through the outdoor heat exchanger 7 hits against the airflow directing plates 11, and the remaining part of the airflow passes through spaces between the airflow directing plates 11 without hitting against the airflow directing plates 11. The airflow having hit against the airflow directing plates 11 in the upper range in the casing 9 flows upward along the airflow directing plates 11 while changing a flowing direction of the airflow toward the outer peripheral portion of the propeller fan 101, and then flows into the outer peripheral portion of the propeller fan 101 to flow out from the casing 9 through the air outlet 921. Thus, the airflow is forcibly caused to flow into the outer peripheral portion of the propeller fan 101. Consequently, an air eddy is prevented from being generated in a space between the outer peripheral portion of the propeller fan 101 and the upper end portion of the outdoor heat exchanger 7. Meanwhile, the airflow having passed through the spaces between the airflow directing plates 11 in the upper range in the casing 9 directly flows into an inner peripheral portion of the propeller fan 101, and then flows out from the casing 9 through the air outlet 921. Thus, unevenness of the distribution of suction air between the inner peripheral portion and the outer peripheral portion of the propeller fan 101 is prevented.

Further, air pressure in the casing 9 during rotation of the propeller fan 101 is lower at a position closer to the propeller fan 101 and higher at a position farther from the propeller fan 101. As a result, there is a fear in that an air velocity distribution, which is a distribution of air velocity in the outdoor heat exchanger 7, is uneven, in other words, the air velocity becomes higher at a position closer to the propeller fan 101. However, the airflow directing plates 11 are opposed to the outdoor heat exchanger 7 at a position close to the propeller fan 101. Further, at a position close to the propeller fan 101 in the outdoor heat exchanger 7, airflow resistance is increased, and thus the air velocity is reduced. Accordingly, the air velocity at a position close to the propeller fan 101 in the outdoor heat exchanger 7 is approximated to the air velocity at a position far from the propeller fan 101 in the outdoor heat exchanger 7, thereby preventing unevenness of the air velocity distribution in the outdoor heat exchanger 7.

In the outdoor unit 3 described above, the plurality of airflow directing plates 11, which are opposed to the end portion of the outdoor heat exchanger 7 on the propeller fan 101 side from the axis A side of the propeller fan 101, are not opposed to the curved portions 72 of the outdoor heat exchanger 7 but are opposed to the flat surface portions 71 of the outdoor heat exchanger 7. Accordingly, the airflow directing plates 11 can forcibly cause the airflow having passed through the end portion of the outdoor heat exchanger 7 on the propeller fan 101 side to flow into the outer peripheral portion of the propeller fan 101. Thus, the air eddy can be less liable to be generated in a space between the outer peripheral portion of the propeller fan 101 and the outdoor heat exchanger 7, thereby being capable of achieving noise reduction. Further, a part of the airflow having passed through the end portion of the outdoor heat exchanger 7 on the propeller fan 101 side can be caused to flow into the inner peripheral portion of the propeller fan 101. Accordingly, the airflow can be prevented from being sucked to an extremely small amount at the inner peripheral portion of the propeller fan 101, thereby being capable of reducing unevenness of the distribution of suction air of the propeller fan 101 between the inner peripheral portion and the outer peripheral portion of the propeller fan 101. Thus, unevenness of the air velocity distribution in the propeller fan 101 can be prevented, and efficiency of the propeller fan 101 can be enhanced. In addition, the airflow directing plates 11 are opposed to the end portion of the outdoor heat exchanger 7 on the propeller fan 101 side so that the airflow resistance is increased. Thus, the air velocity at the end portion of the outdoor heat exchanger 7 on the propeller fan 101 side can be approximated to the air velocity at a position far from the propeller fan 101 in the outdoor heat exchanger 7. As a result, unevenness of the air velocity distribution in the outdoor heat exchanger 7 can be reduced, and efficiency of heat exchange in the outdoor heat exchanger 7 can be enhanced.

Further, each of the airflow directing plates 11 is formed of a flat plate. Accordingly, the airflow directing plates 11 can easily be manufactured.

Embodiment 2

Figure 6:
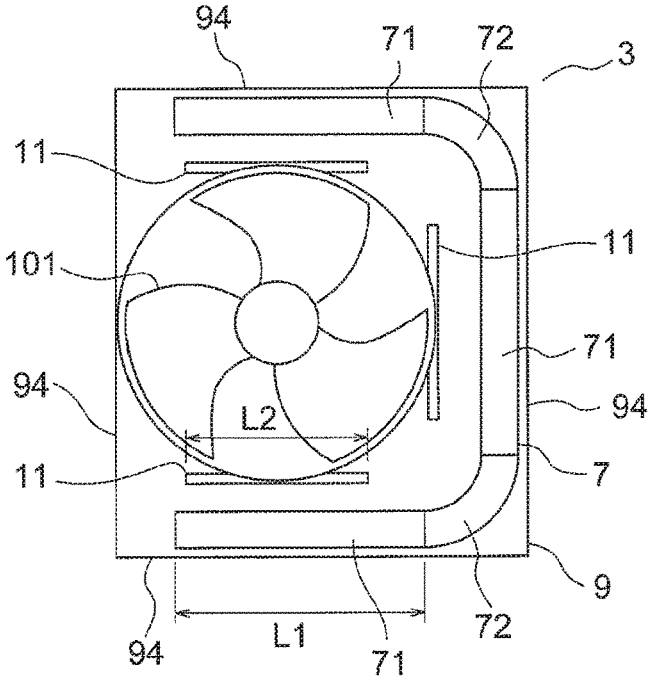
FIG. 6 is a top view for illustrating an outdoor unit according to Embodiment 2 of the present invention.

FIG. 6 is a top view for illustrating the outdoor unit 3 according to Embodiment 2 of the present invention. In Embodiment 2, in a case where comparison is made between lengths of the airflow directing plate 11 and the flat surface portion 71 that are opposed to each other when the outdoor unit 3 is seen from the direction extending along the axis A, a length L2 of the airflow directing plate 11 is smaller than a length L1 of the flat surface portion 71. That is, regarding the airflow directing plate 11 and the flat surface portion 71 that are opposed to each other, the length of the airflow directing plate 11 is smaller than the length of the flat surface portion 71 on the plane perpendicular to the axis A. The other components are the same as the components of Embodiment 1.

In the outdoor unit 3 described above, the length L2 of the airflow directing plate 11 is smaller than the length L1 of the flat surface portion 71 on the plane perpendicular to the axis A. With this configuration, each of the airflow directing plates 11 can be reliably prevented from being opposed to the curved portions 72. Thus, the airflow resistance at a position close to the propeller fan 101 in the outdoor heat exchanger 7 can be further reliably prevented from being excessively large.

Embodiment 3

Figure 7:
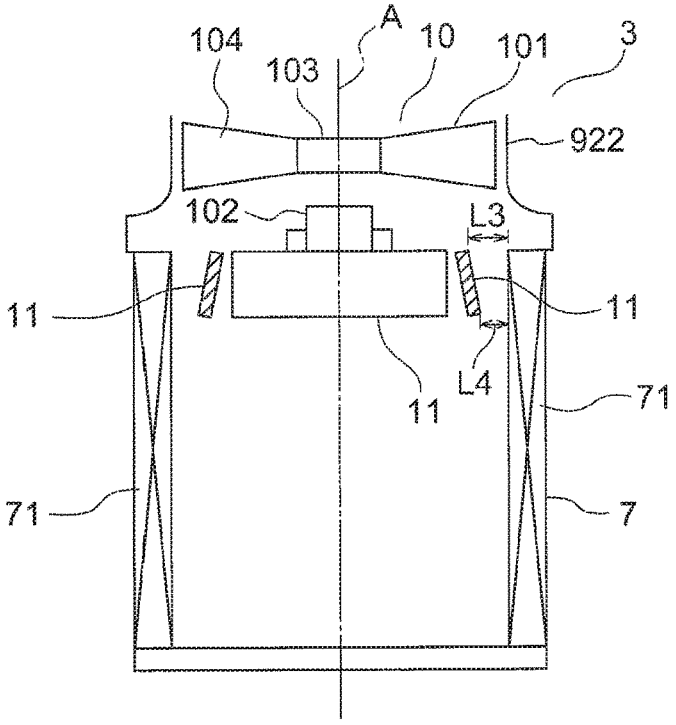
FIG. 7 is a schematic vertical sectional view for illustrating an outdoor unit according to Embodiment 3 of the present invention.

FIG. 7 is a schematic vertical sectional view for illustrating the outdoor unit 3 according to Embodiment 3 of the present invention. FIG. 7 is a view corresponding to FIG. 5 for illustrating Embodiment 1. Each airflow directing plate 11 is arranged obliquely to the plane perpendicular to the axis A so that a distance between the airflow directing plate 11 and the axis A is decreased as a portion of the airflow directing plate 11 approaches the propeller fan 101 arranged above the outdoor heat exchanger 7. With this configuration, a distance between the airflow directing plate 11 and the flat surface portion 71 that are opposed to each other is increased as a portion of the airflow directing plate 11 approaches the propeller fan 101 arranged above the outdoor heat exchanger 7. That is, a distance L3 between an upper end portion of the airflow directing plate 11 and the flat surface portion 71 is larger than a distance L4 between a lower end portion of the airflow directing plate 11 and the flat surface portion 71. The other components are the same as the components of Embodiment 1.

In the outdoor unit 3 described above, the distance between the airflow directing plate 11 and the flat surface portion 71 is increased as a portion of the airflow directing plate 11 approaches the propeller fan 101. Accordingly, as a portion of the airflow directing plate 11 approaches the propeller fan 101, in other words, as a portion of the airflow directing plate 11 approaches a downstream side of the airflow flowing toward the propeller fan 101, a flow path for the airflow formed between the outdoor heat exchanger 7 and the airflow directing plate 11 can be enlarged, thereby being capable of preventing increase in air velocity in a space between the outdoor heat exchanger 7 and the airflow directing plate 11. Thus, the airflow resistance at the end portion of the outdoor heat exchanger 7 on the propeller fan 101 side can be further reliably prevented from being excessively large.

Embodiment 4

Figure 8:
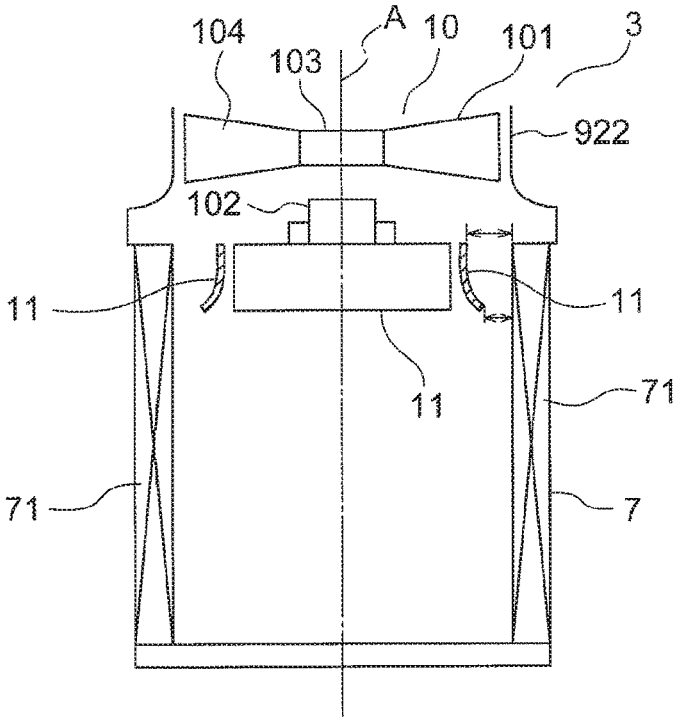
FIG. 8 is a schematic vertical sectional view for illustrating an outdoor unit according to Embodiment 4 of the present invention.

FIG. 8 is a schematic vertical sectional view for illustrating the outdoor unit 3 according to Embodiment 4 of the present invention. FIG. 8 is a view corresponding to FIG. 5 for illustrating Embodiment 1. Each of the airflow directing plates 11 is formed of a curved plate having a recessed front surface and a protruding back surface. Further, each of the airflow directing plates 11 is arranged so that the recessed front surface and the protruding back surface thereof face the flat surface portion 71 and the axis A, respectively. That is, a cross-sectional shape of each of the airflow directing plates 11 taken along a plane containing the axis A is a curved shape having a recessed front surface and a protruding back surface that face the flat surface portion 71 side and the axis A side, respectively. With this configuration, an inclination angle of each of the airflow directing plates 11 with respect to the plane perpendicular to the axis A becomes smaller at a position farther from the propeller fan 101, but becomes continuously larger at a position closer to the propeller fan 101. Further, the distance between the airflow directing plate 11 and the flat surface portion 71 that are opposed to each other is increased as a portion of the airflow directing plate 11 approaches the propeller fan 101 arranged above the outdoor heat exchanger 7, but a rate of increase of the distance between the airflow directing plate 11 and the flat surface portion 71 is decreased as a portion of the airflow directing plate 11 approaches the propeller fan 101. The other components are the same as the components of Embodiment 3.

In the outdoor unit 3 described above, the front surface of each airflow directing plate 11 is recessed into a curved shape, and the recessed front surface of the airflow directing plate 11 faces the flat surface portion 71. Accordingly, the airflow directing plate 11 can smoothly change a direction of the airflow having flowed into the casing 9 through the outdoor heat exchanger 7. Thus, the airflow resistance at the end portion of the outdoor heat exchanger 7 on the propeller fan 101 side can be further reliably prevented from being excessively large.

In the above-mentioned example, the sectional shape of each airflow directing plate 11 is a curved shape, but the present invention is not limited thereto. The sectional shape of the airflow directing plate 11 may be a polygonal shape having a plurality of continuous sides, and the airflow directing plate 11 may be arranged so that a recessed front surface and a protruding back surface of the polygonal shape face the flat surface portion 71 and the axis A side, respectively.

Embodiment 5

Figure 9:
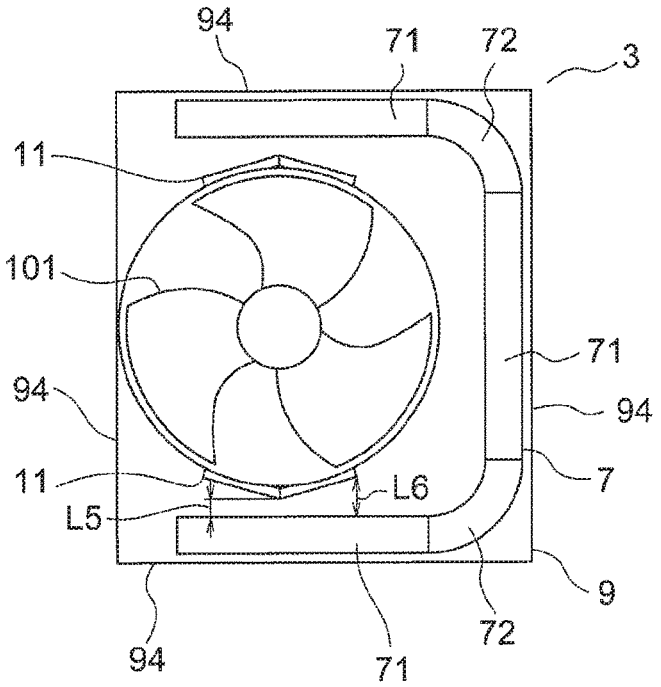
FIG. 9 is a top view for illustrating an outdoor unit according to Embodiment 5 of the present invention.

FIG. 9 is a top view for illustrating the outdoor unit 3 according to Embodiment 5 of the present invention. FIG. 9 is a view corresponding to FIG. 4 for illustrating Embodiment 1. In this example, the airflow directing plates 11 are opposed to, among the three flat surface portions 71, only two flat surface portions 71 opposed to each other. Therefore, in this example, two airflow directing plates 11 are arranged in the casing 9.

On the plane perpendicular to the axis A, a distance between the airflow directing plate 11 and the flat surface portion 71 that are opposed to each other is minimum at a position of an intermediate portion of the airflow directing plate 11, and is increased from the position of the intermediate portion of the airflow directing plate 11 toward a position of each end portion of the airflow directing plate 11. That is, on the plane perpendicular to the axis A, a distance L5 between the intermediate portion of the airflow directing plate 11 and the flat surface portion 71 is minimum, and a distance L6 between each end portion of the airflow directing plate 11 and the flat surface portion 71 is maximum. In this example, a cross-sectional shape of the airflow directing plate 11 taken along the plane perpendicular to the axis A is a V-shape. Further, in this example, on the plane perpendicular to the axis A, a distance between each end portion of the airflow directing plate 11 and the axis A is equal to a distance between the intermediate portion of the airflow directing plate 11 and the axis A. The other components are the same as the components of Embodiment 1.

In the outdoor unit 3 described above, on the plane perpendicular to the axis A, the distance between the airflow directing plate 11 and the flat surface portion 71 is minimum at the position of the intermediate portion of the airflow directing plate 11, and is increased from the position of the intermediate portion of the airflow directing plate 11 toward each end portion of the airflow directing plate 11. Therefore, the distance between the airflow directing plate 11 and the flat surface portion 71 can be larger at a position of each end portion of the airflow directing plate 11 than at the position of the intermediate portion of the airflow directing plate 11. Thus, the airflow resistance at the position close to the propeller fan 101 in the outdoor heat exchanger 7 can be prevented from being excessively large. Further, the distance between the airflow directing plate 11 and the axis A can be approximated to a uniform distance in a rotating direction of the propeller fan 101, and hence a distance between the outer peripheral portion of the propeller fan 101 and the airflow directing plate 11 when the outdoor unit 3 is seen from the direction extending along the axis A can be approximated to a uniform distance. Thus, a flow fluctuation of the airflow accompanied by rotation of the propeller fan 101 can be prevented, and energy loss and noise of the propeller fan 101 can be reduced. That is, efficiency of the propeller fan 101 can be further enhanced.

In the above-mentioned example, the airflow directing plates 11 are opposed to only two of the three flat surface portions 71. However, the airflow directing plates 11 may be opposed to all of the three flat surface portions 71, respectively, or the airflow directing plate 11 may be opposed to only one flat surface portion 71.

Further, in the above-mentioned example, the sectional shape of each of the airflow directing plates 11 taken along the plane perpendicular to the axis A is a V-shape. However, the sectional shape of the airflow directing plate 11 may be a polygonal shape having three or more continuous sides, or a curved shape. With this configuration, the distance between the outer peripheral portion of the propeller fan 101 and the airflow directing plate 11 when the outdoor unit 3 is seen from the direction extending along the axis A can be further approximated to a uniform distance, and efficiency of the propeller fan 101 can be further enhanced.

Embodiment 6

Figure 10:
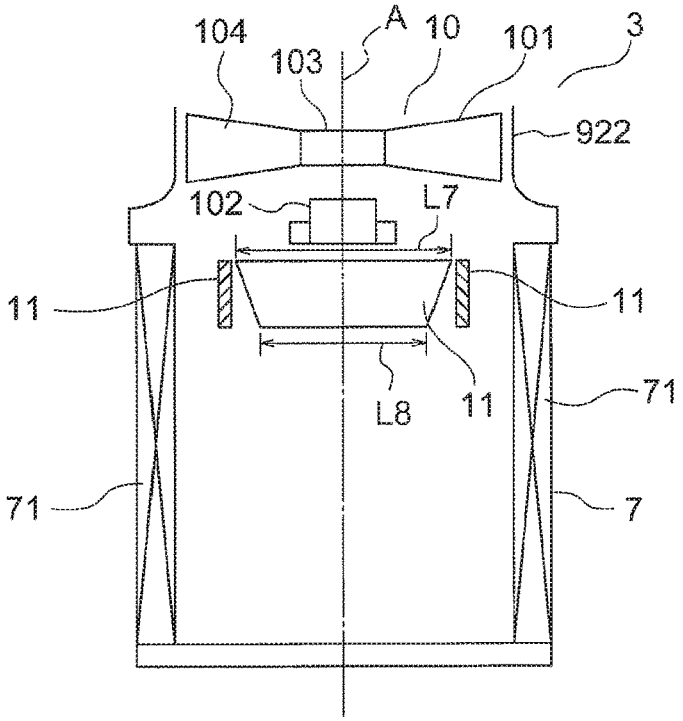
FIG. 10 is a schematic vertical sectional view for illustrating an outdoor unit according to Embodiment 6 of the present invention.

FIG. 10 is a schematic vertical sectional view for illustrating the outdoor unit 3 according to Embodiment 6 of the present invention. FIG. 10 is a view corresponding to FIG. 5 for illustrating Embodiment 1. On the plane perpendicular to the axis A, a length of each airflow directing plate 11 is increased as a portion of each airflow directing plate 11 approaches the propeller fan 101. That is, regarding the length of each airflow directing plate 11 on the plane perpendicular to the axis A, a length L7 at a position of an upper end portion of the airflow directing plate 11 is larger than a length L8 at a position of a lower end portion of the airflow directing plate 11. In this example, the airflow directing plate 11 has a trapezoid shape when seen from the axis A. With this configuration, an area of each of the airflow directing plates 11 opposed to the flat surface portion 71 is decreased as a portion of each of the airflow directing plates 11 is away from the propeller fan 101. The other components are the same as the components of Embodiment 1.

In the outdoor unit 3 described above, the length of each airflow directing plate 11 on the plane perpendicular to the axis A is increased as a portion of each airflow directing plate 11 approaches the propeller fan 101. Therefore, the airflow resistance generated in the outdoor heat exchanger 7 by the airflow directing plates 11 can be decreased as the airflow directing plates 11 are away from the propeller fan 101, and increase of the airflow resistance generated in the outdoor heat exchanger 7 by the airflow directing plates 11 can be prevented. Thus, the airflow resistance at the position close to the propeller fan 101 in the outdoor heat exchanger 7 can be prevented from being excessively large.

Embodiment 7

Figure 11:
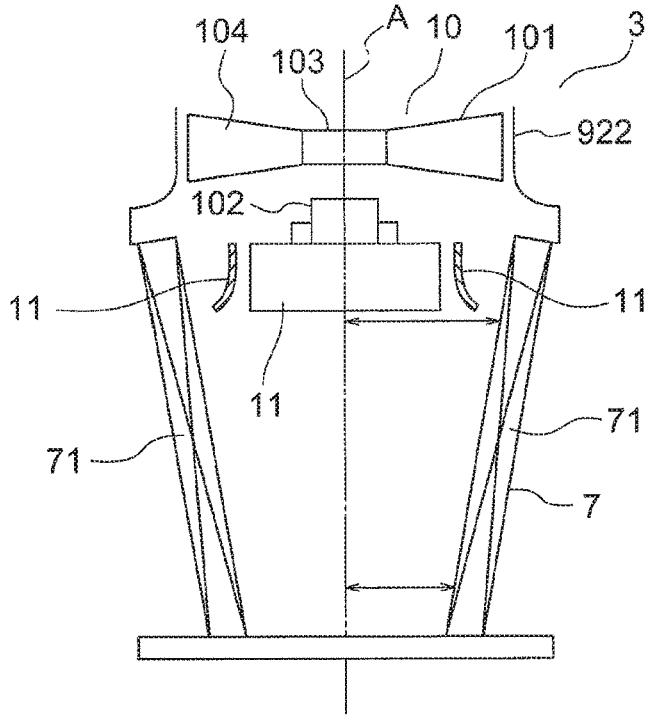
FIG. 11 is a schematic vertical sectional view for illustrating an outdoor unit according to Embodiment 7 of the present invention.

FIG. 11 is a top view for illustrating the outdoor unit 3 according to Embodiment 7 of the present invention. FIG. 11 is a view corresponding to FIG. 5 for illustrating Embodiment 1. The outdoor heat exchanger 7 is inclined with respect to the axis A. Further, on the plane perpendicular to the axis A, a distance between the outdoor heat exchanger 7 and the axis A is continuously increased as a portion of the outdoor heat exchanger 7 approaches the propeller fan 101. The other components are the same as the components of Embodiment 4.

In the outdoor unit 3 described above, the distance between the outdoor heat exchanger 7 and the axis A on the plane perpendicular to the axis A is increased as a portion of the outdoor heat exchanger 7 approaches the propeller fan 101. Therefore, a direction of the airflow flowing through the outdoor heat exchanger 7 into the casing 9 can be approximated to a direction toward the propeller fan 101. Thus, there can be reduced an angle of the airflow, which is forcibly changed by the airflow directing plates 11 in the casing 9, and the airflow resistance can be prevented from being excessively large at the end portion of the outdoor heat exchanger 7 on the propeller fan 101 side.

In the above-mentioned example, the curved airflow directing plates 11 of Embodiment 4 are applied to the outdoor unit 3 including the outdoor heat exchanger 7 inclined with respect to the axis A. However, the airflow directing plates 11 of Embodiment 1, 2, 3, 5, or 6 may be applied to the outdoor unit 3 including the outdoor heat exchanger 7 inclined with respect to the axis A.

Further, in Embodiments 1 to 4, 6, and 7 described above, the airflow directing plates 11 are opposed to all of the flat surface portions 71 of the outdoor heat exchanger 7. However, the airflow directing plate 11 may be opposed to at least any one of the flat surface portions 71.

Further, in Embodiments described above, when seen from the direction extending along the axis A, the outdoor heat exchanger 7 has a U-shape defined by the three flat surface portions 71 and the two curved portions 72 connected to one another, but the present invention is not limited thereto. When seen from the direction extending along the axis A, the outdoor heat exchanger 7 may have, for example, an L-shape defined by two flat surface portions 71 and one curved portion 72 connected to one another, or a C-shape defined by four flat surface portions 71 and three curved portions 72 connected to one another. In addition, the outdoor heat exchanger 7 having a U-shaped cross section and the outdoor heat exchanger 7 having a flat surface shape may be combined with each other, or the two outdoor heat exchangers 7 each having an L-shaped cross section may be combined with each other so that the outdoor heat exchangers 7 have a rectangular shape as a whole when seen from the direction extending along the axis A. Further, the two outdoor heat exchangers 7 each having a U-shaped cross section may be combined with each other in an opposed manner so that the outdoor heat exchangers 7 have a rectangular shape as a whole when seen from the direction extending along the axis A. Still further, the outdoor heat exchanger 7 having an L-shaped cross section and the outdoor heat exchanger 7 having a flat surface shape may be combined with each other so that the outdoor heat exchangers 7 have a U-shape as a whole when seen from the direction extending along the axis A.

Further, in Embodiments described above, the present invention is applied to the outdoor unit to be used for an air-conditioning apparatus being a refrigeration cycle apparatus, but the present invention is not limited thereto. The present invention may be applied to an outdoor unit to be used for, for example, a water heater being a refrigeration cycle apparatus.

Further, the present invention is not limited to Embodiments described above, and can be carried out with various changes within the scope of the present invention. Further, the present invention can also be carried out with combinations of Embodiments described above.

The invention claimed is:

1. An outdoor unit for a refrigeration cycle apparatus, comprising:

an air-sending device comprising a propeller fan configured to generate an airflow by rotating about an axis of the propeller fan;

an outdoor heat exchanger, which is arranged around the axis on an upstream side of the airflow with respect to the propeller fan, and comprises a first flat surface portion, a second flat surface portion, and a curved portion connecting the first flat surface portion and the second flat surface portion to each other; and an airflow directing plate arranged so as to be opposed to an end portion of the outdoor heat exchanger on the propeller fan side from the axis side, the airflow directing plate being arranged so as to be opposed to at least any one of the first flat surface portion and the second flat surface portion without being opposed to the curved portion, wherein, on a plane perpendicular to the axis, the airflow directing plate has a length that is larger at a position of an end portion of the airflow directing plate on a side close to the propeller fan than at a position of an end portion of the airflow directing plate on a side far from the propeller fan.

2. An outdoor unit for a refrigeration cycle apparatus according to claim 1, wherein, on a plane perpendicular to the axis, the airflow directing plate has a length smaller than a length of the at least any one of the first flat surface portion and the second flat surface portion to which the airflow directing plate is opposed.

3. An outdoor unit for a refrigeration cycle apparatus according to claim 1, wherein a distance between the airflow directing plate and the at least any one of the first flat surface portion and the second flat surface portion, to which the airflow directing plate is opposed, is increased as a portion of the airflow directing plate approaches the propeller fan.

4. An outdoor unit for a refrigeration cycle apparatus according to claim 3, wherein the airflow directing plate is formed into a shape having a recessed front surface of the airflow directing plate and a protruding back surface of the airflow directing plate, and wherein the airflow directing plate is arranged so that the recessed front surface faces the at least any one of the first flat surface portion and the second flat surface portion, to which the airflow directing plate is opposed.

5. An outdoor unit for a refrigeration cycle apparatus according to claim 1, wherein, on the plane perpendicular to the axis, a distance between the airflow directing plate and the at least any one of the first flat surface portion and the second flat surface portion, to which the airflow directing plate is opposed, is minimum at a position of an intermediate portion of the airflow directing plate, and is increased from the position of the intermediate portion toward a position of each end portion of the airflow directing plate.

6. An outdoor unit for a refrigeration cycle apparatus according to claim 1, wherein, on the plane perpendicular to the axis, the airflow directing plate has a length being increased as a portion of the airflow directing plate approaches the propeller fan.

7. An outdoor unit for a refrigeration cycle apparatus according to claim 1, wherein a distance between the axis and the outdoor heat exchanger is increased as a portion of the outdoor heat exchanger approaches the propeller fan.

8. A refrigeration cycle apparatus, comprising the outdoor unit for a refrigeration cycle apparatus of claim 1.

9. An outdoor unit for a refrigeration cycle apparatus according to claim 2, wherein a distance between the airflow directing plate and the at least any one of the first flat surface portion and the second flat surface portion, to which the airflow directing plate is opposed, is increased as a portion of the airflow directing plate approaches the propeller fan.

* * * * *